US006234161B1

(12) United States Patent
Levi et al.

(10) Patent No.: US 6,234,161 B1
(45) Date of Patent: May 22, 2001

(54) GAS COOKING APPLIANCE WITH ISOLATED COMBUSTION AND COOLING AIR FLOWS

(75) Inventors: David E. Levi, Apison; Donald E. McCloud; James C. McFarland, both of Cleveland; Jimmy C. Roden, Chattanooga; Eddie M. Brock, Cleveland; Jeffrey D. Ware, Chattanooga, all of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/487,622

(22) Filed: Jan. 20, 2000

(51) Int. Cl.[7] ..... F24C 15/32

(52) U.S. Cl. ..... 126/21 R; 126/273 R; 126/19 R; 126/29 R

(58) Field of Search ..... 126/21 R, 21 A, 126/19 R, 273 R, 275 R, 39 R, 41, 39 B, 198, 277, 214 A, 211, 299 R, 299 D, 214 R; 219/400

(56) References Cited

U.S. PATENT DOCUMENTS

| | | | | |
|---|---|---|---|---|
| 3,659,578 | * | 5/1972 | Davis et al. | 1269/21 R |
| 3,889,099 | * | 6/1975 | Nuss | 126/198 |
| 3,921,617 | | 11/1975 | Rumbaugh . | |
| 3,926,171 | | 12/1975 | Kurek et al. . | |
| 4,180,049 | * | 12/1979 | Carr et al. | 126/21 R |
| 4,411,254 | | 10/1983 | Field et al. . | |
| 4,413,610 | | 11/1983 | Berlik . | |
| 4,413,611 | | 11/1983 | Berlik et al. . | |
| 4,598,691 | * | 7/1986 | Herrelko et al. | 126/19 R |
| 4,705,019 | | 11/1987 | Beach et al. . | |
| 4,736,729 | | 4/1988 | Beach . | |
| 4,750,470 | | 6/1988 | Beach et al. . | |
| 4,865,010 | * | 9/1989 | Kett | 126/21 R |
| 5,046,477 | | 9/1991 | Bennett et al. . | |
| 5,119,802 | | 6/1992 | Cherry et al. . | |
| 5,209,217 | | 5/1993 | Beach et al. . | |
| 5,213,091 | | 5/1993 | Beach . | |
| 5,325,842 | | 7/1994 | Beach et al. . | |
| 5,474,055 | * | 12/1995 | Kang | 126/273 R |

* cited by examiner

*Primary Examiner*—James C. Yeung
(74) *Attorney, Agent, or Firm*—Everett G. Diederiks, Jr.

(57) ABSTRACT

A gas cooking appliance, having burner units mounted on an upper cooktop and an oven cavity arranged below the burner units, incorporates a fan for generating a flow of cooling air within the appliance, with the cooling air extending along an at least back and top wall portions of the oven cavity. The cooling air exits the appliance through a frontal gap formed between a door of the oven cavity and an upper frontal portion of the appliance. The burner units have associated combustion air inlets which are isolated from the flow of cooling air by being disposed in a chamber formed by sealing an isolation pan beneath the cooktop. The cooktop is formed with a plurality of openings for permitting a flow of combustion air to be drawn into the chamber for mixing with a regulated flow of combustion gas. With this arrangement, the gas burner units are isolated from the flow of cooling air within the appliance to enhance the operation of the burner units, particularly during low or simmer settings.

20 Claims, 2 Drawing Sheets

GAS COOKING APPLIANCE WITH ISOLATED COMBUSTION AND COOLING AIR FLOWS

BACKGROUND OF THE INVENTION

1. Field of the Invention

The present invention pertains to the art of cooking appliances and, more particularly, to an arrangement for isolating combustion and cooling air flows within a gas cooking appliance.

2. Discussion of the Prior Art

It is quite common to provide a system to cool a domestic oven so that the exterior of the oven is safe to touch during periods of operation and to further protect various control components and instruments from extreme heat. This condition can be extremely important in pyrolytic self-cleaning ovens as such ovens can operate at rather extreme temperatures. Even at lower operating temperatures, it is still desirable to create a cooling air flow about portions of an oven cavity for various reasons.

In gas cooking appliances, it is necessary to not only consider the possibility of providing a flow of cooling air within the appliance, but also a flow of air which is adapted to mix with a supply of gas for combustion purposes. In the art, it has been proposed to direct a portion of the air which flows around an oven cavity to cool the same to air intakes of surface burners incorporated in the cooking appliance. Since the surface burners may not be utilized simultaneously with the oven cavity and the oven cavity generally requires a higher degree of air flow for cooling purposes than is required by the surface burners for operation, such cooking appliances are designed to have particular venting areas for the majority of the cooling air flow. Some of these prior known arrangements provide the venting adjacent to the front door associated with the oven cavity. With such an arrangement, the opening and closing of the oven door can negatively affect surface burner operation. That is, changes in the cooling air flow can disturb the flames associated with the surface burner elements, particularly when the burner elements are operated in low or simmer settings.

Based on the above, the prior art has attempted to control the negative effects of changes in pressure or flow rate of the cooling air on the overall operation of the surface burners. However, there still exists a need in the art for a gas cooking appliance arrangement that will enable an effective cooling air flow for the oven cavity to be developed, with variations in this cooling air flow not adversely affecting surface burner operation. More particularly, there exists a need to totally isolated the combustion air flow for the surface burners from the cooling air flow for the oven cavity within an appliance in order to enhance the effective and efficient operation of the surface burners.

SUMMARY OF THE INVENTION

The present invention is directed to providing a gas cooking appliance with separate and distinct oven cavity cooling and surface burner combustion air flows. More particularly, the present invention is directed to a gas cooking appliance including a cooktop to which is mounted a plurality of gas burner units having burner heads positioned upon the cooktop and flow tubes extending below the cooktop. Also incorporated is an oven cavity arranged below the cooktop. A fan is provided within the appliance to generate a flow of cooling air for the oven cavity, with the cooling air being adapted to flow within a passage extending across a top wall of the oven cavity and below the cooktop. In order to isolate the gas burner units from the flow of cooling air, a pan extends from and is sealed to the cooktop in a manner which essentially encapsulates the flow tubes of the gas burner units. The cooktop is provided with one or more openings which lead into a chamber defined by the cooktop and the isolation pan in order to permit a separate flow of combustion air to the gas burner units.

With this arrangement, the flow of cooling air generated during operation of the oven is completely separated from the flow of combustion air for the gas burner units within the cooking appliance. Preferably, the flow of cooling air exits the cooking appliance through a venting gap defined between the cooktop and a door of the oven cavity. The cooktop is preferably designed such that the combustion air openings are located at a level above an upper plane of the burner units to further isolate the flames of the burners from the flow of combustion air.

Additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
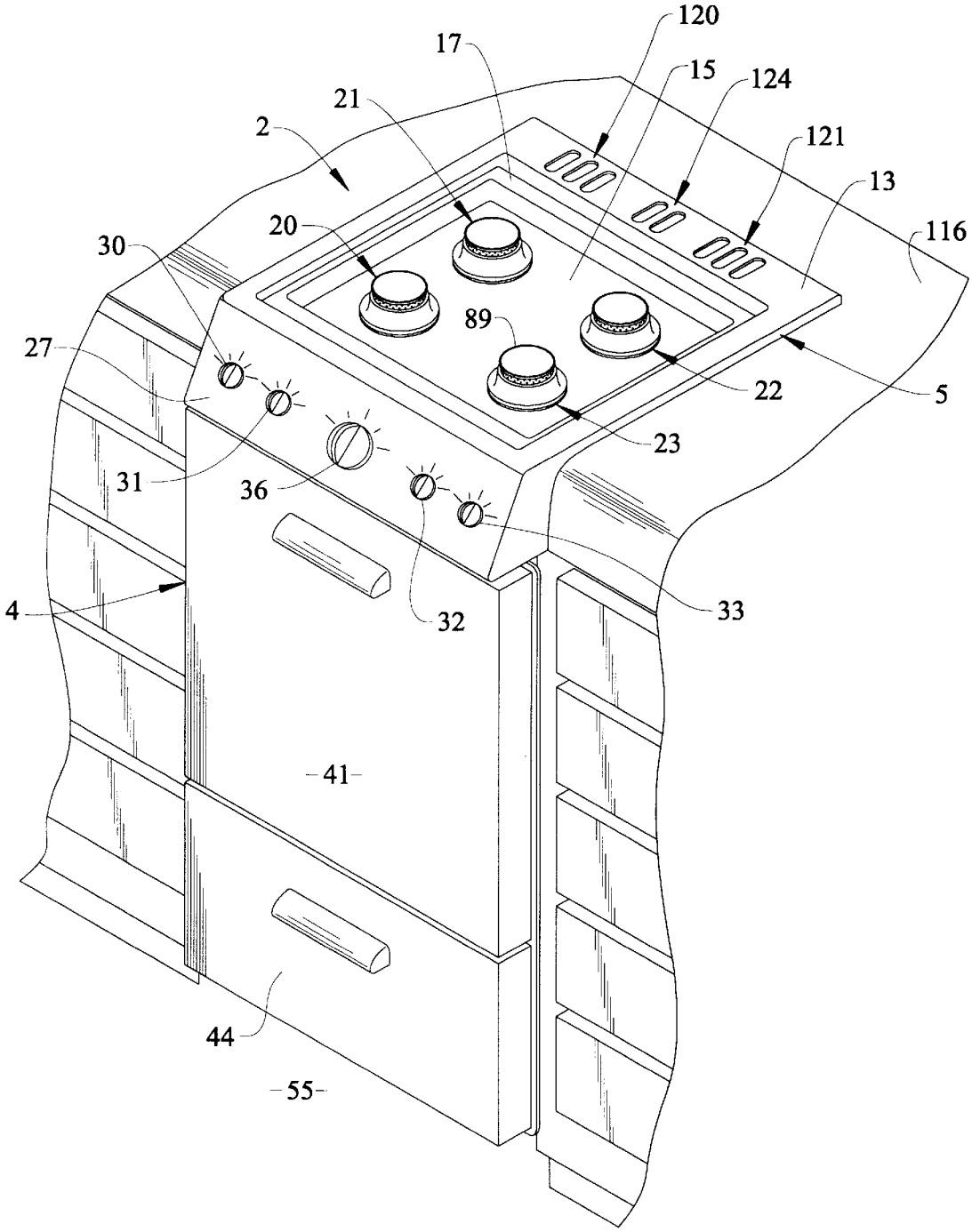
FIG. 1 is an upper right perspective view of a gas cooking appliance constructed in accordance with the present invention mounted in a countertop/cabinet area.
Figure 2:
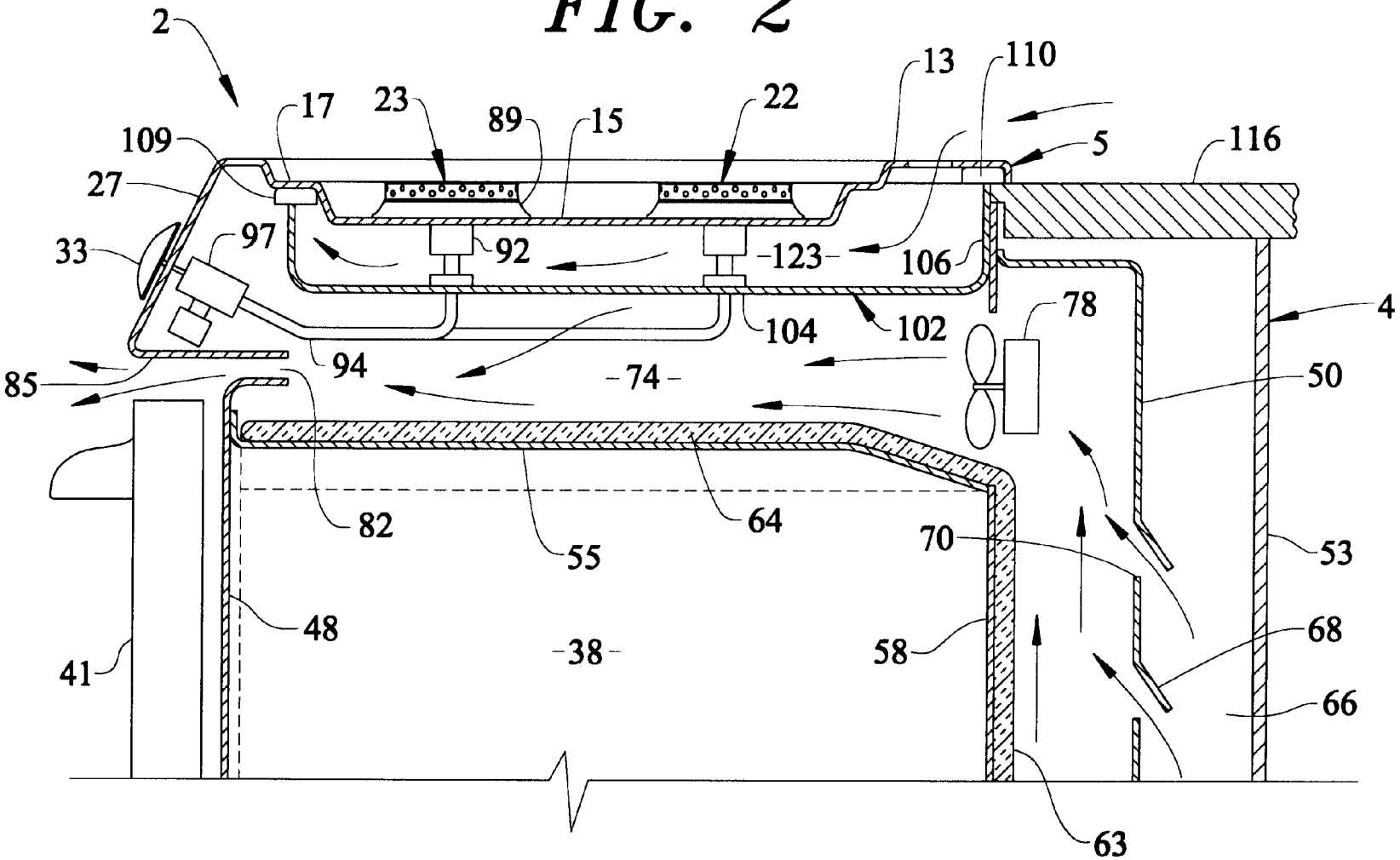
FIG. 2 is generally a cross-sectional side view of the cooking appliance of FIG. 1.

With reference to FIGS. 1 and 2, a gas cooking appliance constructed in accordance with the present invention is generally indicated at 2. Appliance 2 includes a cabinet 4 including a cooktop 5. In the embodiment depicted, cooktop 5 includes an upper peripheral portion 13 that extends about a recessed or a well area 15. Between peripheral portion 13 and well area 15 is shown a ledge 17 that can support one or more grates (not shown). Mounted to cooktop 5, within well area 15, is a plurality of gas burner units 20–23 as will be discussed more fully below.

Cooktop 5 leads to a front panel portion 27 that is preferably angled downwardly and forwardly. Front panel portion 27 has mounted thereto a plurality of control knobs 30–33 for regulating the operation of gas burner units 20–23 respectively. Front panel portion 27 also has provided thereon a central control knob 36 that is used to actuate one or more heating elements (not shown) associated with an oven cavity 38 of appliance 2. In a manner known in the art, oven cavity 38 has associated therewith a door 41 which is pivotal between opened and closed positions for permitting access into and closing off oven cavity 38 respectively. As clearly shown in FIG. 1 for the sake of completeness, appliance 2 is shown to include a slidable pan or bin 44 that extends below oven cavity 38.

Cabinet 4 shown to include a front panel 48, a main back panel 50 and a rear panel 53. Of course, although not shown, cabinet 4 would also include side panels. FIG. 2 illustrates top and rear wall portions 55 and 58 of oven cavity 38. Obviously, oven cavity 38 would also be further defined by front panel 48, as well as bottom and side walls (not shown). In a manner generally known in the art, oven cavity 38 is preferably insulated through the use of a plurality of wraps 63 and 64, with insulation wrap 63 extending about the side walls and rear wall 58 of oven cavity 38, while wrap 64 extends about the bottom, side and top wall 55 of oven cavity 38.

As will become more fully evident below, the basic construction of gas cooking appliance 2 can vary without departing form the invention. Instead, the invention is particularly concerned with the manner in which cooling air is directed about oven cavity 38 and combustion air is delivered to gas burner units 20–23, as well as the manner in which the combustion air for the gas burning units is isolated from the flow of cooling air within cabinet 4. More specifically, it is desired in accordance with the present invention to create a flow of cooling air about oven cavity 38. For this purpose, cabinet 4 is raised above a supporting surface or floor 55 by a plurality of legs or the like (not shown) in a manner generally indicated in FIG. 1. With this arrangement, air is permitted to flow below cabinet 4 and into a zone 66 defined between main back panel 50 and back panel 53. Main back panel 50 is preferably formed of metal and is stamped to create louvers 68 which define openings 70 that permit a flow of cooling air from within zone 66 to an air passage 74 defined about oven cavity 38. In FIG. 2, a set of upper openings 70 are shown and it is to be understood that corresponding lower openings would also be provided within main back panel 50.

In accordance with the most preferred embodiment of the invention, the flow of cooling air is forcibly generated by incorporating a fan 78 within cabinet 4. Fan 78 can simply operate whenever oven cavity 38 is being utilized or can actually be temperature sensitive. In addition, fan 78 can operate at a constant speed or variable speeds without departing from the invention. In any event, due to the very extreme temperatures that can be generated during use of oven cavity 38, there is a desire to create a flow of cooling air about oven cavity 38 within cabinet 4. Therefore, fan 78 is operated to draw a flow of cooling air beneath slidable pan 44 of appliance 2 into zone 66 and then into air passage 74. As clearly shown, air passage 74 extends at least along rear wall 58 and top wall 55 of oven cavity 38. The flow of cooling air is permitted to exit cabinet 4 through an elongated vent gap or opening 82 defined above oven door 41. More specifically, front panel portion 27 leads to an in-turned flange 85 and vent gap 82 is defined between flange 85 and both a portion of front panel 48 and door 41 as clearly shown in FIG. 2. Again, it is preferable to incorporate fan 78 to forcibly draw the cooling air in. In the preferred embodiment, fan 78 is located in air passage 74 to draw the air across rear wall 58 of oven cavity 38 and to further blow the cooling air across the crucial top wall 55 of oven cavity 38 and through vent gap 82.

In accordance with an aspect of the invention as indicated above, it is desirable to isolate the flow of cooling air from the flow of combustion air needed for gas burners 20–23. In the preferred embodiment, each gas burning unit 20–23 is defined by a burner head 89, which is preferably sealed within well area 15, and a flow tube 92 that projects below cooktop 5. A respective gas line 94, which leads from a valve 97 associated with one of knobs 30–33, is used to direct a flow of combustion gas to flow tube 92. In accordance with the preferred embodiment of the invention, gas line 94 extends through an isolation pan 102 which has a bottom 104 and annular side wall 106. Isolation pan 102 is sealed to an underside of cooktop 5 through the use of first and second sectional seals 109 and 110. As clearly shown in FIG. 2, seal 110 preferably also aids in sealing cooktop 5 to countertop 116.

With this arrangement, flow tubes 92 are essentially encapsulated by cooktop 5 and isolation pan 102. In this manner, flow tubes 92 are isolated from the flow of cooling air within cabinet 4. In order to provide a flow of combustion air for use by gas burning units 20–23, cooktop 5 is provided with various sets of inlets or openings, such as those indicated at 120 and 121 in FIG. 1. Although the general shape and arrangement of combustion air inlets or openings 120 and 121 can greatly vary in accordance with the present invention, it is preferable to provide openings 120 and 121 in upper peripheral portion 13 of cooktop 5. In this manner, the various sets of openings 120 and 121 are arranged in a plane which is above gas burner units 20–23. During operation of one or more of the gas burner units 20–23, combustion air will be drawn into openings 120, 121 which lead to a chamber 123 defined by cooktop 5 and isolation pan 102. Since openings 120 and 121 are arranged above gas burner units 20–23, there is little tendency for the flow of combustion air to affect flame quality even when gas burner units 20–23 are utilized on low or simmer settings. Once the combustion air is directed into chamber 123, it can enter a respective flow tube 92 to mix with gas flowing through line 94. At this point, it should be understood that the overall construction of gas burner units 20–23 is not the subject of the present invention. Instead, these burner units generally take the form set forth in U.S. Pat. No. 5,152,276 which is herein incorporated by reference. For the sake of completeness, upper peripheral portion 13 of cooktop 5 is also shown to include a central set of openings 124 which actually function as an exhaust venting area for oven cavity 38. That is, a venting tube (not shown) leads from oven cavity 38 to the central set of openings 124 for venting of oven cavity 38. The venting of oven cavities, in general, is widely known in the art and, aside from the particular location, is not considered part of the present invention.

Based on the above description, it should be readily apparent that the presence of fan 102 and the sealing of the isolation pan 102 to cooktop 5 assures that the operation of gas burner units 20–23 will be unaffected by the flow of cooling air developed by fan 78, even though the flow of cooling air generally flows between top wall 35 of oven cavity 38 and cooktop 5. In addition, the creation of chamber 123 and the ability of gas burner units 20–23 to readily draw in necessary combustion air through cooktop 5 enables a steady and dedicated flow of combustion air for enhanced operation of gas burner units 20–23. It has been found that this arrangement advantageously enables gas burner units 20–23 to be effectively utilized at low or simmer settings without the flames at burner heads 89 being adversely affected by variations in air pressures within cabinet 4 that can be created through the operation of fan 78 and even the simple opening and closing of door 41. In any event, the gas cooking appliance 2 constructed in accordance with the present invention isolates the combustion and cooling air flows, while defining an adequately sized chamber 123 for the combustion air. With the chamber 123 being isolated from the flow of cooling air, the flow rate of the cooling air can be actually increased over known prior art arrangements to optimize cooling within cabinet 4.

Although described with respect to a preferred embodiment of the invention, it should be readily apparent that various changes and/or modifications can be made to the invention without departing from the spirit thereof. Instead, the invention is only intended to be limited by the scope of the following claims.

We claim:

1. A gas cooking appliance comprising:

a cabinet including an upper cooktop and a back panel;

an oven cavity located within the cabinet, said oven cavity including an open frontal portion, a rear wall spaced forward of the back panel and a top wall spaced below the upper cooktop;

an isolation pan extending below the upper cooktop, between the upper cooktop and the top wall of the oven cavity;

a plurality of gas burner units, each of the gas burner units including a burner head positioned above the upper cooktop, and a flow tube leading from the burner head into a chamber defined by the upper cooktop and the isolation pan;

an air inlet for directing combustion air to the flow tube within the chamber;

a gas inlet line leading to the flow tube of a respective one of the gas burner units for supplying combustion gas adapted to mix with the combustion air within the flow tube; and a fan for generating a flow of cooling air for the oven cavity within the cabinet, said cooling air being adapted to flow within a passage extending across the top wall of the oven cavity, between the top wall and the isolation pan, while being fluidly isolated, within the cabinet, from the chamber.

2. The gas cooking appliance according to claim 1, wherein the air inlet is formed in the upper cooktop and leads into the chamber.

3. The gas cooking appliance according to claim 2, wherein the air inlet includes a plurality of openings provided within the cooktop for the introduction of combustion air into the chamber.

4. The gas cooking appliance according to claim 3, wherein the openings are located at a level above an upper plane of the gas burner units.

5. The gas cooking appliance according to claim 1, wherein the isolation pan is substantially sealed, except for the air inlet, such that combustion air is drawn into the chamber through the air inlet during operation of at least one of the gas burner units.

6. The gas cooking appliance according to claim 1, further comprising:

a front panel;

a door pivotally mounted for movement between opened and closed positions for permitting access to and closing off the oven cavity respectively; and a vent gap formed between the front panel and the door, wherein the flow of cooling air exits the cabinet through the vent gap.

7. The gas cooking appliance according to claim 6, wherein the cooling air flows, within the cabinet, along the rear wall and then across the top wall of the oven cavity towards the vent gap.

8. The gas cooking appliance according to claim 6, wherein the cabinet further comprises a main back panel provided with a plurality of openings for introducing the flow of cooling air into the passage.

9. A gas cooking appliance comprising:

an upper cooktop;

a plurality of gas burner units, each gas burner unit including a burner head sealed to the upper cooktop and a flow tube leading to the burner head from beneath the upper cooktop;

an isolation pan sealed to the cooktop such that a chamber is formed about the flow tubes of said gas burner units being positioned within the chamber;

an air inlet for directing combustion air into the chamber;

a gas inlet line leading to the flow tube of a respective one of the gas burner units for supplying combustion gas adapted to mix with the combustion air within the flow tube;

an oven cavity positioned below the upper cooktop, with the oven cavity including a top wall spaced below the isolation pan by an air flow passage; and a fan for generating a flow of cooling air through the air flow passage, with the flow of cooling air being isolated from the chamber along the entire air flow passage.

10. The gas cooking appliance according to claim 9, wherein the air inlet is formed in the upper cooktop and leads into the chamber.

11. The gas cooking appliance according to claim 10, wherein the air inlet includes a plurality of openings provided within the cooktop for the introduction of combustion air into the chamber.

12. The gas cooking appliance according to claim 11, wherein the openings are located at a level above an upper plane of the gas burner units.

13. The gas cooking appliance according to claim 9, wherein the isolation pan is substantially sealed, except for the air inlet, such that combustion air is drawn into the chamber through the air inlet during operation of at least one of the gas burner units.

14. The gas cooking appliance according to claim 9, further comprising:

a front panel;

a door pivotally mounted for movement between opened and closed positions for permitting access to and closing off the oven cavity respectively; and a vent gap formed between the front panel and the door, wherein the flow of cooling air exits the cabinet through the vent gap.

15. A method of introducing and isolating combustion and cooling air flows within a gas cooking appliance including an oven cavity mounted below a cooktop that is provided with a plurality of gas burner units having burner heads positioned above the cooktop and gas and air flow mixing tubes located below the cooktop comprising:

introducing a flow of combustion air for the gas burner units into a chamber formed in the appliance below the cooktop;

forcibly generating a flow of cooling air about portions of the oven cavity within the appliance during operation of the oven cavity, wherein the cooling air is directed through a passage located between the cooktop and a top wall of the oven cavity; and permitting the cooling air to flow through the passage while isolating the gas burner units from the flow of cooling air within the appliance.

16. The method according to claim 15, further comprising: introducing the flow of combustion air into the chamber through the cooktop.

17. The method according to claim 16, further comprising: introducing the flow of combustion air through the cooktop at a level above the burner heads.

18. The method according to claim 15, further comprising: exhausting the flow of cooling air from the appliance through an elongated gap formed between a door of the oven cavity and an upper frontal portion of the appliance.

19. The method according to claim 15, further comprising: forcibly generating the flow of cooling air by operating a fan mounted within the appliance.

20. The method according to claim 15, further comprising:

sealingly mounting an isolation pan to the cooktop to form the chamber; and drawing the flow of combustion air into the chamber during operation of one or more of the gas burner units.

* * * * *